US006352456B1

(12) United States Patent
Jaszewski et al.

(10) Patent No.: US 6,352,456 B1
(45) Date of Patent: Mar. 5, 2002

(54) MARINE PROPULSION APPARATUS WITH ADJUSTABLE TILLER HANDLE

(75) Inventors: Wayne M. Jaszewski, Jackson; George E. Phillips, Oshkosh; John M. Griffiths, Fond du Lac, all of WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 09/665,875

(22) Filed: Sep. 20, 2000

(51) Int. Cl.[7] ..... B63H 5/125
(52) U.S. Cl. ..... 440/53
(58) Field of Search ..... 440/53, 63, 900, 440/55; 248/640–643

(56) References Cited

U.S. PATENT DOCUMENTS

| | | | | |
|---|---|---|---|---|
| 2,926,544 A | * | 3/1960 | Carmichael, Jr. | |
| 3,503,360 A | * | 3/1970 | Hoff | 440/63 |
| 4,076,193 A | | 2/1978 | Weaver | 248/4 |
| 4,094,482 A | | 6/1978 | Weaver | 248/4 |
| 4,521,201 A | | 6/1985 | Watanabe | 440/55 |
| 4,604,067 A | * | 8/1986 | Roberts | 440/49 |
| 4,633,800 A | | 1/1987 | Wolf, Jr. | 114/144 |
| 5,046,974 A | | 9/1991 | Griffin, Jr. | 440/63 |
| 5,052,320 A | | 10/1991 | Cremer | 114/146 |
| 5,632,657 A | | 5/1997 | Henderson | 440/6 |
| 5,741,165 A | | 4/1998 | Saito et al. | 440/57 |
| 5,794,557 A | | 8/1998 | Geukens | 114/144 |
| 5,797,777 A | | 8/1998 | Tsunekawa et al. | 440/84 |

* cited by examiner

*Primary Examiner*—Ed Swinehart
(74) *Attorney, Agent, or Firm*—William D. Lanyi

(57) ABSTRACT

A marine propulsion apparatus is provided in which a support structure is attached to an internal combustion engine to support the engine and allow the engine to be pivoted about a steering axis. A steering handle is attached to the support structure and the steering handle is rotatable within a range about an axis. A driveshaft housing is attached to the internal combustion engine and a driveshaft is supported within the housing. The apparatus can be raised or lowered relative to a bracket which comprises a support cylinder. The steering handle is adjustable within a range of travel and the entire marine apparatus can be raised or lower to accommodate various different types of marine vessels.

5 Claims, 5 Drawing Sheets

MARINE PROPULSION APPARATUS WITH ADJUSTABLE TILLER HANDLE

BACKGROUND OF THE INVENTION

1. Field of the Invention

The present invention is generally related to a marine propulsion apparatus and, more particularly, to an outboard motor support structure with an adjustable handle which allows the outboard motor to be used in conjunction with many different types of marine vessels and in many different types of applications.

2. Description of the Prior Art

Many different types of tiller handles are well known to those skilled in the art in the fields of outboard motors and other marine propulsion devices.

U.S. Pat. No. 5,741,165, which issued to Salto et al on Apr. 21, 1998, describes a marine propulsion system that includes a combined vertically extending drive shaft driven by the propulsion unit and which drives a generally horizontally extending propeller shaft that drives a propeller position substantially rearwardly of the transom. The propulsion system is supported for steering and trim movement about respective spaced apart axes and these axes are both disposed below the transom of the associated watercraft. The propeller driven by the propeller shaft is disposed further from the trim axis than the forward end of a tiller that is affixed to the outboard drive for affecting steering and trim movement.

U.S. Pat. No. 5,052,320, which issued to Cremer on Oct. 1, 1991, describes an emergency tiller for outboard motors. The invention provides an emergency tiller mechanism for an outboard motor movable about a steering axis by a tiller steering arm attached thereto. The emergency tiller mechanism comprises a durable, flexible flat pad having backing of non-slip material, which firmly cushions a plate to a side or a top surface of the motor housing, and a compressible rubbery top. The plate and pad are secured to the motor housing by a pair of strong, durable, non-slip straps tightened around the motor and plate. A hollow support socket is secured to the outer surface of the pate into which the tiller steering arm is secured. The tiller arm extends horizontally within the cockpit of the boat.

U.S. Pat. No. 4,521,201, which issued to Watanabe on Jun. 4, 1985, describes a steering device for an outboard motor. The steering device for an outboard motor releasably restrains the motor in a predetermined position and can be automatically released upon the exertion of more than a predetermined force to the motor to steer it in the event of an emergency. The releasable restraining device is also automatically engageable upon return of the motor to its first position and can be manually released.

U.S. Pat. No. 4,633,800, which issued to Wolf on Jan. 6, 1987, describes a sailboat tiller. A catamaran tiller has a grip which is provided to determine tension to be applied to the tiller more easily. In one embodiment, the grip extends laterally from a sleeve which fits over the tiller rod and is secured thereto at a desired location. Provision is made to have the grip rotatably mounted on the sleeve or for the sleeve to be secured with the grips in alternative positions. A circular grip is also disclosed.

U.S. Pat. No. 4,076,193, which issued to Weaver on Feb. 28, 1978, describes a transom mount for a fishing motor. The mount has a clamp for mounting the motor tube of a fishing motor on the transom of a boat for swinging between a vertical operating position and a horizontal stowed position over the boat. A yoke for holding the motor tube is swiveled on the clamp and a manually releasable catch bracket pivoted on the yoke locks the yoke to the clamp in the operating position. A biased clip on the clamp releasably locks the yoke in the stowed position.

U.S. Pat. No. 4,094,482, which issued to Weaver on Jun. 13, 1978, describes a deck mount for a fishing motor. The mount has a base bracket for mounting the motor tube of a fishing motor on a boat deck for swinging between a vertical operating position and a horizontal stowed position over the deck. A clamping yoke for holding the motor tube is swiveled on the bracket and a manually releasable latch pivoted on the bracket selectively locks the clamping yoke in the operating and stowed positions when the yoke is swung to either position.

U.S. Pat. No. 5,046,974, which issued to Griffin et al on Sep. 10, 1991, describes an ancillary tiller for steerable outboard motors. The tiller provides a first shorter arm releasably interconnectable by mounting structure at its first end to an outboard motor and movably interconnecting by articulating linkage at its second end a second longer elongate arm. The motor mounting structure is adapted for selective interconnection to a motor shaft, tiller, or guide grip. The articulating linkage interconnecting the first and second arm is of a combined axle and ball and socket type that allows a universal positioning of the second arm relative to the first arm and provides locking mechanism to releasably maintain such positioning. The second arm comprises two slidably related elongate elements having locking mechanism communicating therebetween to releasably maintain a selected length. The ancillary tiller is particularly adapted for steerage of small fishing boats powered by steering outboard motors.

U.S. Pat. No. 5,632,657, which issued to Henderson on May 27, 1997, describes a multi-position adjustable trolling motor tiller handle. A movable handle mounted to a trolling motorhead is disclosed in which the handle is pivotally adjustable upwardly and downwardly to suit positions of a fisherman while controlling the trolling motor. The handle spans across the motorhead and acts as a tiller for pivoting the motor about its axis. The resistance to positional changes is adjustable and protective features are provided to prevent damage to the adjustment mechanism in the event of tightening. The handle incorporates various controls for the motorhead.

U.S. Pat. No. 5,794,557, which issued to Geukens on Aug. 18, 1998, describes a steering device for a vessel. The invention relates to a steering device for a vessel comprising at least one rudder arranged to pivot about a substantially vertical extending rudder pivoting axis and comprising at least one operating handle mounted on an operating handle pivot shaft extending in the longitudinal direction of the vessel, which operating handle is arranged to pivot an imaginary plane extending substantially vertically and transversely to the longitudinal axis of the vessel, the operating handle being connected to the rudder via at least one coupling mechanism, so that a pivoting movement of the operating handle causes a pivoting movement of the rudder about the rudder pivoting axis.

U.S. Pat. No. 5,797,777, which issued to Tsunekawa et al on Aug. 25, 1998, describes an outboard motor control mechanism. The control handle for the tiller of an outboard motor that embodies a twist-grip throttle control, a pivotally supported transmission control and a trim switch is disclosed. These elements are juxtaposed to each other but oriented in such a way so that actuation of one will not affect accidental actuation of any other control. The trim control is disposes in a projection on the lower side of the outer housing of the control handle and is disposed inwardly from the sides thereof and is protected by a flange.

The patents described above are hereby expressly incorporated by reference in the description of the present invention.

Many types of outboard motors which incorporate internal combustion engines are not easily adaptable to wide varieties of marine vessels, such as canoes, dugouts, jon boats, and other types of marine vessels which are used for either recreation or as a working vessel. In addition, many known types of outboard motors are not sufficiently inexpensive to allow their widespread use in developing countries. It would therefore be significantly beneficial if a marine propulsion system could be developed that was inexpensive and which allowed a wide degree of latitude in its use with many different types of boats.

SUMMARY OF THE INVENTION

A marine propulsion apparatus made in accordance with the present invention comprises a support structure and an internal combustion engine attached for support to the support structure. A bracket is shaped to be attached to a marine vessel wherein the support structure is rotatably attached to the bracket about a generally vertical steering axis. A steering handle is rotatably attached to the support structure with the steering handle being configured to rotate about a generally horizontal axis which is generally perpendicular to the steering axis of the marine propulsion apparatus. A driveshaft housing extends from the internal combustion engine and a driveshaft is rotatably attached in torque transmitting relation to the internal combustion engine, with the driveshaft being disposed within the driveshaft housing. A propeller shaft is supported by the driveshaft housing and connected in torque transmitting relation with the driveshaft.

The steering handle comprises a first portion and a second portion, with the second portion of the steering handle being extendable from the first portion to increase the overall length of the steering handle. The second portion of the steering handle comprises a plurality of holes which are alignable with at least one hole formed in the first portion of the steering handle, wherein a pin is disposable through one of the plurality of holes in the second portion and through the one hole formed in the first portion of the steering handle. Insertion of a pin in this manner locks the first and second portions to each other and prevents relative axial movement between them. The first portion of the steering handle can be a tube and the second portion can be disposed within the tube.

The support structure of the present invention is shaped to form a carrying handle in a particularly preferred embodiment and the bracket comprises a support cylinder. The driveshaft housing is slidably and rotatably disposed within the support cylinder and a stop mechanism can be attached to the driveshaft housing and can be shaped to prevent the stop mechanism from moving relative to the support cylinder so that the stop mechanism limits vertical movement of the driveshaft housing relative to the bracket. The stop mechanism, which can be a pin inserted through holes in both the driveshaft housing and the support cylinder, is movable relative to the driveshaft housing to select a plurality of positions at which the stop mechanism can be attached to the drive mechanism to select a plurality of selectable heights of operation of the internal combustion engine relative to the bracket.

A first locking mechanism is attached to the steering handle for preventing rotation of the steering handle relative to the support structure and about a horizontal axis. A second locking mechanism is attached to the first portion of the steering handle for preventing relative movement between the first and second portions of the steering handle.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
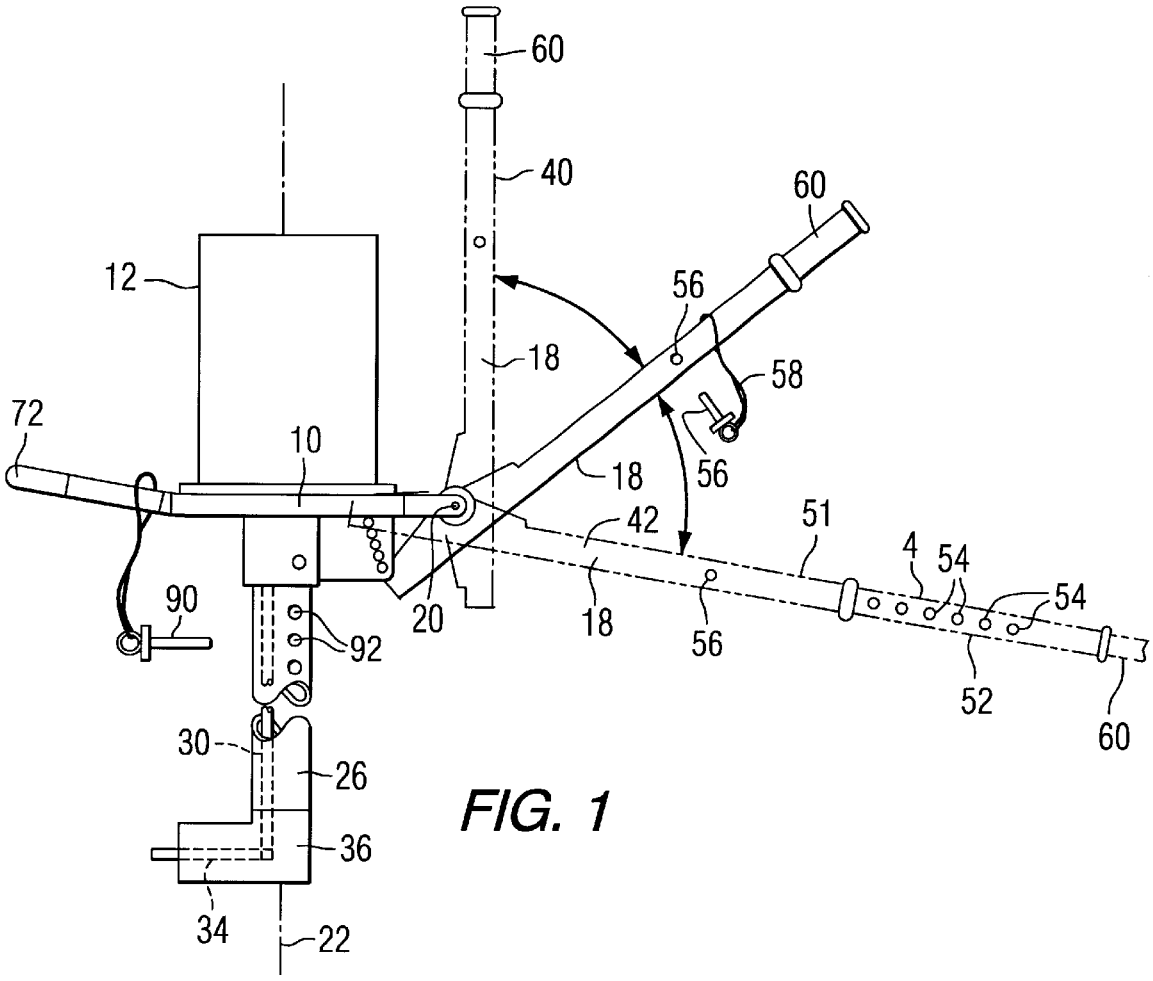
FIG. 1 shows a side view of the present invention.

Throughout the description of the preferred embodiment of the present invention, like components will be identified by like reference numerals.

FIG. 1 shows a support structure 10 of the present invention and an internal combustion engine 12 which is attached for support to the support structure 10. A bracket 16, which will be described in greater detail below in conjunction with FIG. 3, is shaped to be attached to a marine vessel. The support structure 10 is rotatably attached to the bracket 16. A steering handle 18 is rotatably attached to the support structure for rotation about axis 20 which is illustrated as a point in FIG. 1 and as a line in FIG. 2. The steering axis 22 and the axis 20, about which the steering handle 18 rotates, are generally perpendicular to each other, but not necessarily intersecting each other.

A driveshaft housing 26 extends from the internal combustion engine 12 and is attached to the support structure 10 in a particularly preferred embodiment of the present invention. A driveshaft 30 is rotatably attached in torque transmitting relation to the internal combustion engine 12 and is disposed within the driveshaft housing 26. A propeller shaft 34 is supported by the driveshaft housing 26 and connected in torque transmitting relation with the driveshaft 30. The structure of the gear housing 36 is well known to those skilled in the art of outboard motors and will not be described in significant detail herein. Furthermore, the gears used to translate the rotational direction of the driveshaft 30 about a vertical axis to the rotational direction of the propeller shaft 34 about a generally horizontal axis will not be described in detail herein because this arrangement of gears is generally the same as with all conventional outboard motors.

The steering handle 18 is pivotable about axis 20, as illustrated in FIG. 1, and is provided with a range of travel that extends from a generally vertical position 40 to a position below horizontal as identified by reference numeral 42. This pivotability or rotatability of the steering handle 18 about axis 20 allows the vessel operator to stand while steering the vessel or, alternatively, sit forward and below the internal combustion engine 12 when the steering handle 18 is in the position identified by reference numeral 42.

The steering handle 18 is provided with a first portion 51 and a second portion 52. The first portion 51 can be tubular and the second portion 52 can slide within the internal opening of the tubular first portion 51. The second portion 52 is provided with a plurality of holes 54 and the first portion is provided with at least one hole 56. By aligning the one hole 56 of the first portion 51 with one of the plurality of holes 54 in the second portion 52, and inserting a pin 56 through the aligned holes, the second portion 52 can be extended from the first portion 51 and then the first and second portions can be locked in that extended position relative to each other. The pin 56 can be attached to the first portion 51 by a tether 58.

A pistol grip 60 can be provided to allow the operator to control the throttle of the internal combustion engine 12. A cable-in-tube mechanism can be used for these purposes, whereby rotation of the pistol grip 60 relative to the second portion 52 causes movement of the cable within its sheath to move the throttle of the internal combustion engine 12. The cable-in-tube device can be extended through the internal openings of the first and second portions, 51 and 52, or attached to the outer surface of the first and second portions. For throttle control, it should be understood that alternative mechanisms are also within the scope of the present invention. For example, a throttle control similar to the one described in U.S. Pat. No. 5,741,165 can be used. In addition, a throttle control mechanism such as that described in U.S. Pat. No. 5,797,777 can be used. Alternatively, the throttle control can be contained on the internal combustion engine 12 itself without providing the operator with a pistol grip 60 control method. These optional means for controlling the throttle of the internal combustion engine 12 are all alternative options in accordance with the present invention.

The rotatable motion of the steering handle 18 about its axis 20 can be smooth throughout its range of travel or, alternatively, several locations can be selected where a detent-like device prevents further movement of the steering handle 18 until a prescribed amount of force is applied by the marine vessel operator to further pivot the steering handle 18 about axis 20. This type of detent mechanism is described in U.S. Pat. No. 4,521,201. Many different types of mechanisms are known to those skilled in the art for the purpose of maintaining a fixed angular relationship between the steering handle 18 and the support structure 10.

Figure 2:
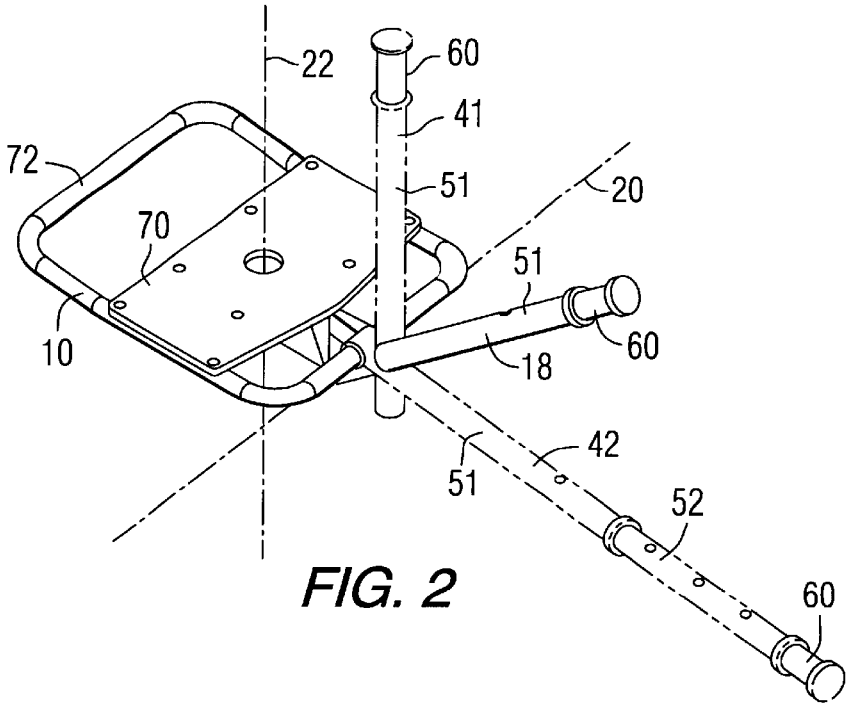
FIG. 2 shows an isometric view of a support structure of the present invention.
Figure 3:
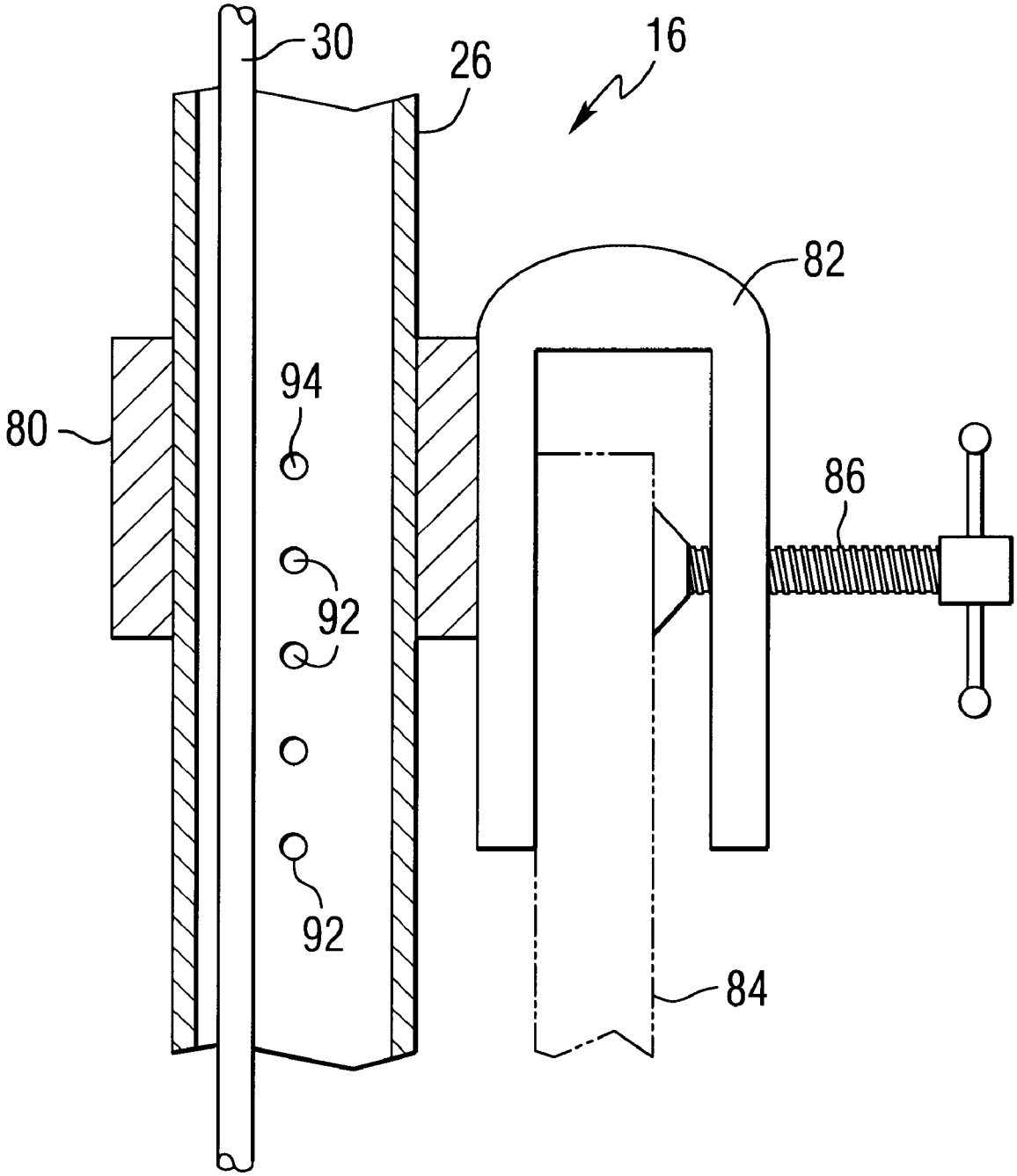
FIG. 3 shows a bracket used to support the marine propulsion apparatus of the present invention.

FIG. 2 shows the support structure 10 without the internal combustion engine 12 or driveshaft housing 26. A plate 70 is attached to the support structure 10 to provide support for an internal combustion engine. A portion of the support structure 10 is shaped to form a handle 72 that allows the marine propulsion apparatus to be carried manually. When carried in this way, the steering handle 18 can be moved to the position identified by reference numeral 40 in FIG. 1 and the handle 72 can be gripped by an operator'hand to permit and assist in the movement of the apparatus.

In FIG. 2, the steering axis 22 can be seen in its relationship to the axis 20 about which the steering handle 18 pivots. The range of travel of the steering handle 18, from position 41 to position 42, has been described above in conjunction with FIG. 1.

FIG. 3 shows the bracket 16 that is shaped to be attached to a marine vessel and in which the support structure is rotatably attached. More specifically, the driveshaft housing 26 is slidably and pivotally disposed within a support cylinder 80. The bracket can comprise a clamping structure 82 which is rigidly attached to the support cylinder 80 and shaped to receive a transom 84 of a marine vessel within its yoke. A clamping mechanism 86 is used to rigidly attach the bracket structure 16 to the transom 84 and support the marine apparatus shown in FIG. 1.

With continued reference to FIG. 3, a hole is provided through both the support cylinder 80 and the driveshaft housing 26 to allow a pin to be inserted through holes which are aligned to select the height of the marine propulsion apparatus relative to the transom 84. The pin 90 is shown in FIG. 1. A plurality of holes 92 are formed in the driveshaft housing 26. A single hole, aligned with hole 94 of the plurality of holes 92, allows the pin 90 to be inserted through a pair of aligned holes, wherein one of the holes is one of the plurality of holes 92 and the other hole is the single hole formed through the thickness of the support cylinder 80.

Figure 4:
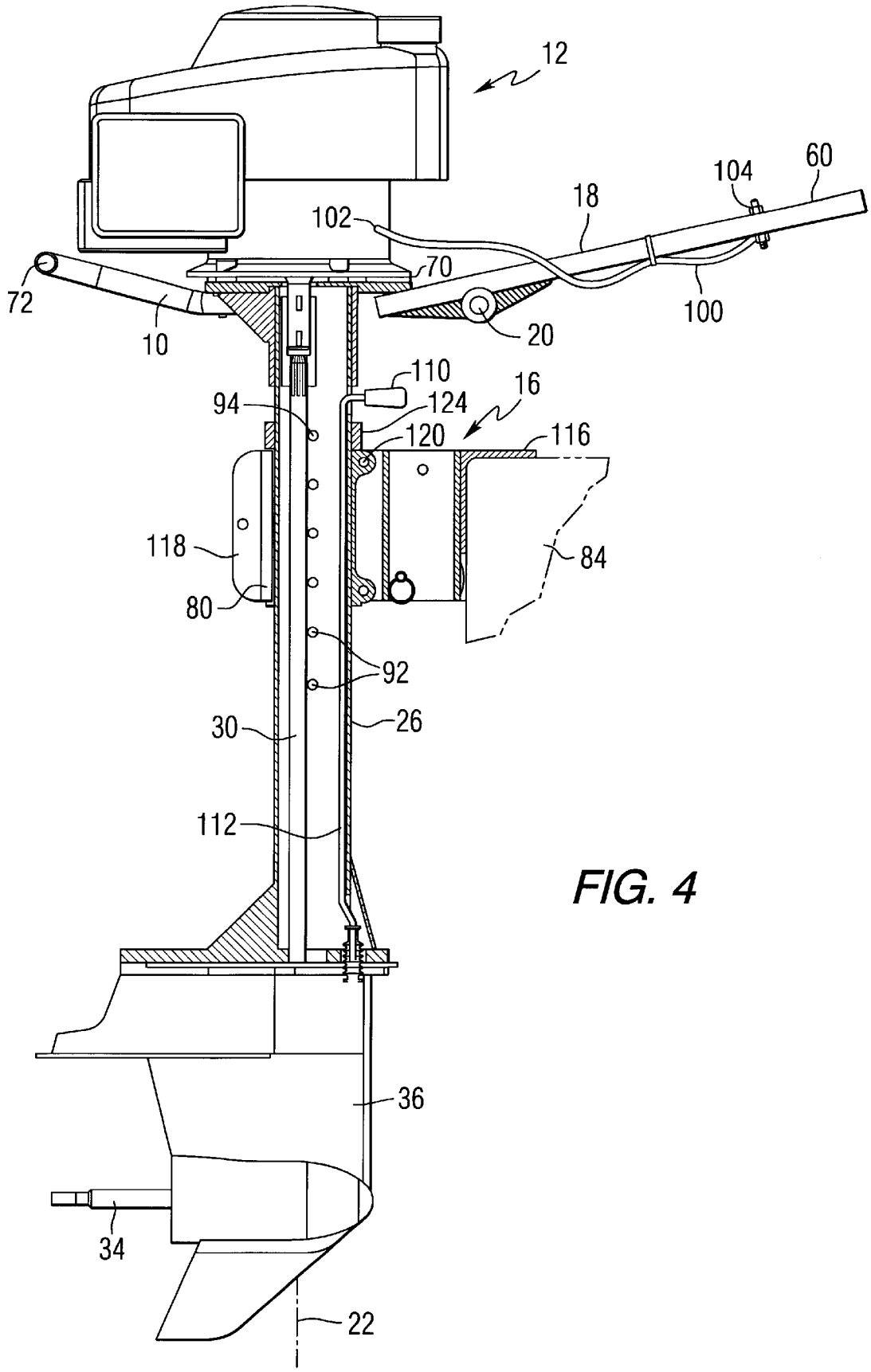
FIG. 4 is a side section view of an outboard motor made in accordance with the present invention.

FIG. 4 is a section view of the present invention showing the outboard motor assembled to the bracket 16. FIGS. 1 and 2 show two schematic representations of portions of the present invention, whereas FIG. 4 illustrates an assembled sectional view. The steering handle 18 is shown in one of its possible positions relative to axis 20. A cable-in-tube 100 is shown extending from the grip 60 to an opening 102 in the housing of engine 12. The mechanism 104 that is actuatable by rotation of the piston grip 60, moves the cable within the cable-in-tube 100 to cause movement of the throttle of the engine 12. The driveshaft housing 26 is rotatable about the steering axis 22 and the driveshaft 30 is shown disposed within the driveshaft housing 26 for rotation by the operation of the engine 12. Although not specifically shown in FIG. 4, it should be understood that the propeller shaft 34 is rotated about its central axis by operation of the driveshaft 30 and the arrangement of gears within the gearcase 36 in a manner that is well known to those skilled in the art of outboard motors. A handle 110 is provided to allow the operator to move a gear shift shaft 112 relative to the driveshaft housing 26 in order to select between forward and reverse gears.

In FIG. 4, the bracket 16 is slightly different than the bracket described above in conjunction with FIG. 3. In FIG. 4, the bracket 16 is intended to be bolted to a transom 84 or other portion of a marine vessel. The angle plate 116 is provided for these purposes. The support cylinder 80, in the embodiment of the bracket 16 shown in FIG. 4, is a split cylinder whose diameter is slightly changeable by clamping two extension tabs 118 together to squeeze against the outer diameter of the driveshaft housing 26. The support cylinder 80 is pivotable relative to the angle plate 16 about a pin which can be a pivot axis provided by the presence of a pin or bolt through holes in the stationary and rotatable portions of the bracket 16. This allows the outboard motor to be trimmed away from the vertical position shown in FIG. 4.

With continued reference to FIG. 4, it should also be noted that a collar 124 is disposed around the outer surface of the driveshaft housing 26. The collar 124 has a hole extending radially through it and the hole is alignable with hole 94 in the driveshaft housing 26. This allows the collar 124 to be pinned to the driveshaft housing at any one of the locations defined by the plurality of holes 92. This collar prevents downward movement of the driveshaft housing 26 relative to the support cylinder 80. Therefore, by pinning the collar 124 to the driveshaft housing 26 at one of the position defined by the plurality of holes 92, the relative position of the engine 12 and propeller shaft 34 relative to a marine vessel transom 84 can be selected.

Figure 5:
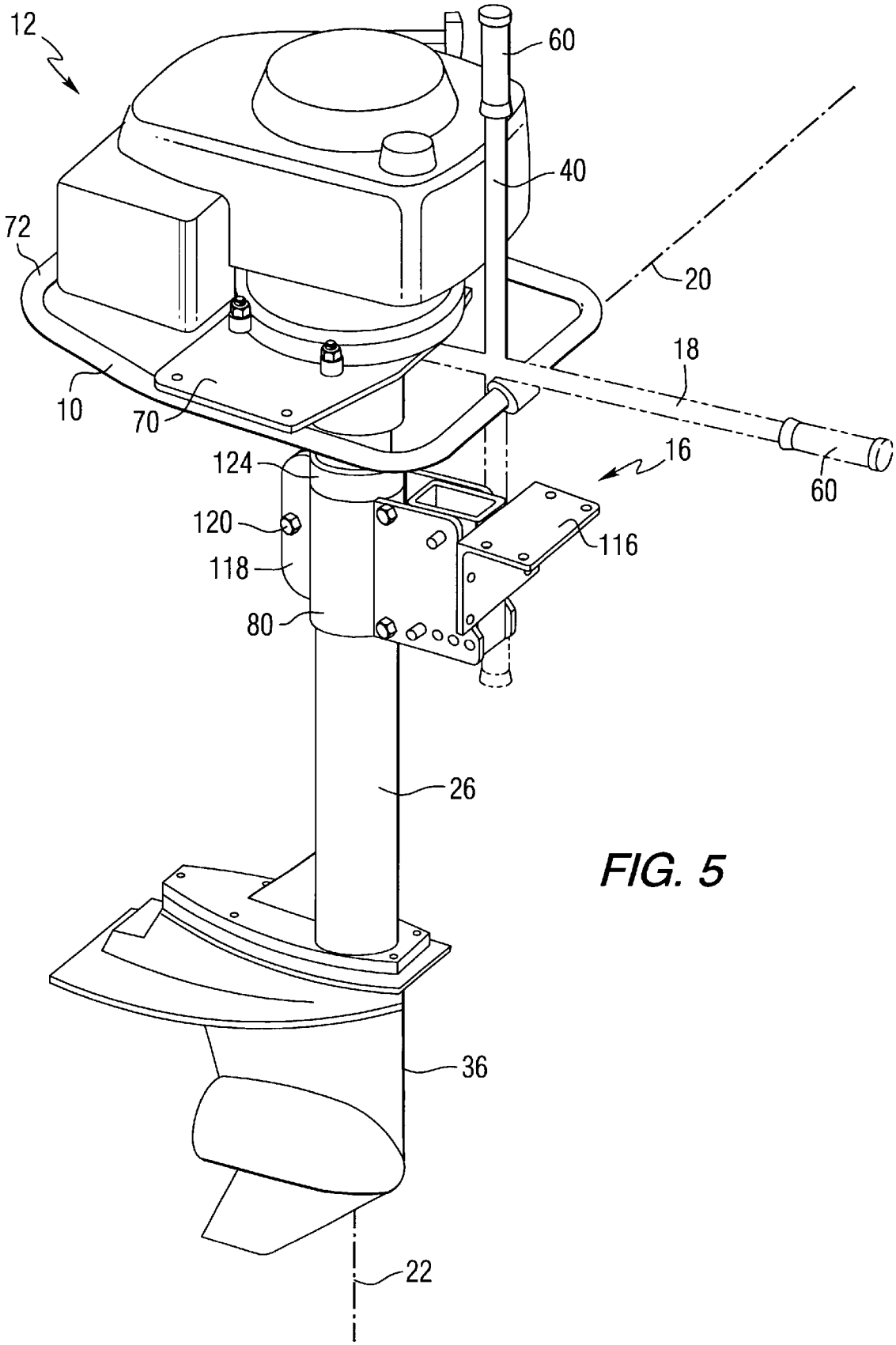
FIG. 5 is an isometric view of the present invention.
Figure 6:
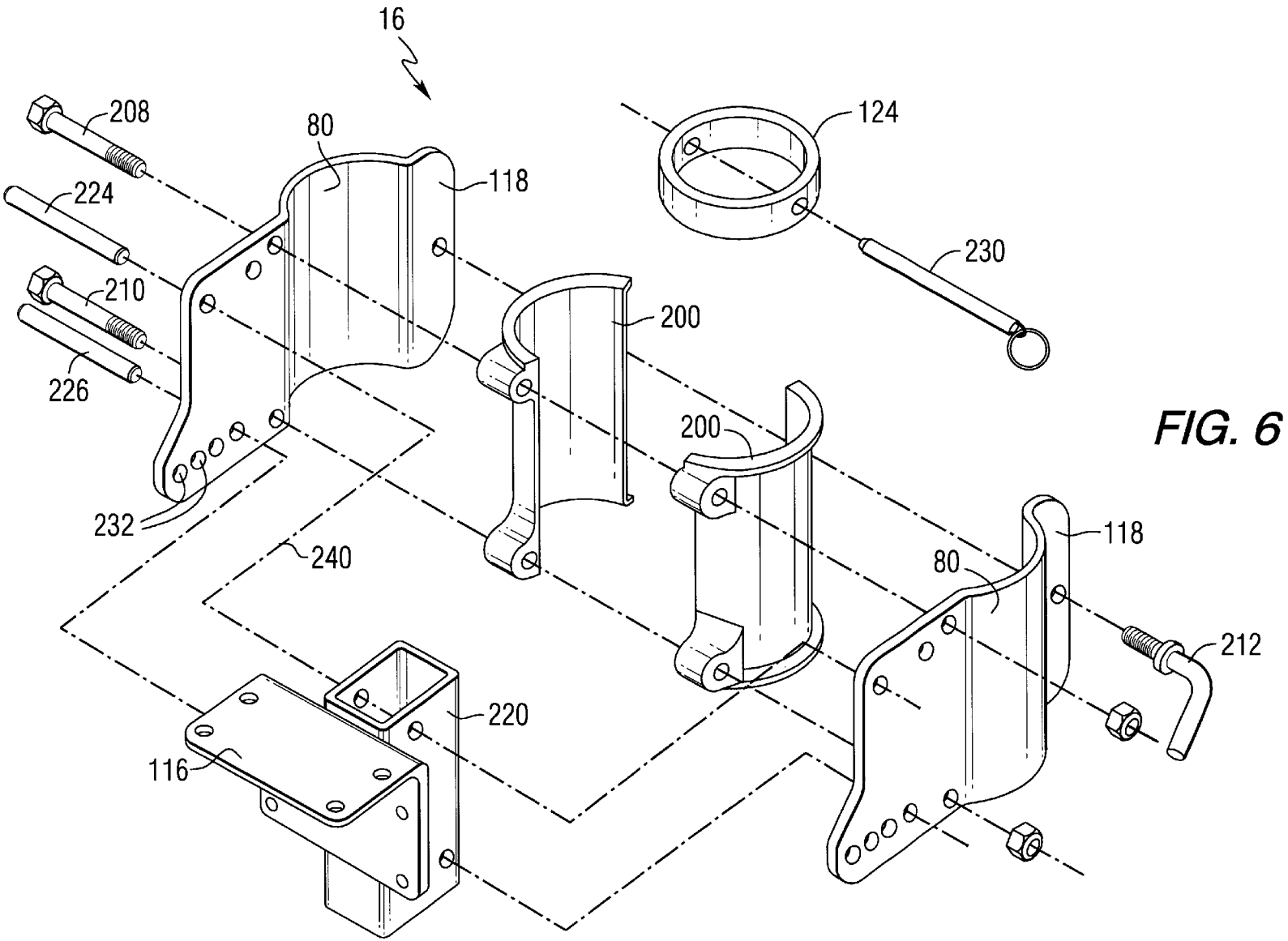
FIG. 6 is an exploded view of the bracket used to attach the present invention to a marine vessel.

FIGS. 5 and 6 show an isometric view of an outboard motor made in accordance with the present invention and an exploded view of the bracket 16, respectively. With reference to both FIGS. 5 and 6, it can be seen that the bracket 16 is made of several components which are shaped to receive the driveshaft housing 26 in slidable association therein. The support cylinder 80 comprises two halves which can be bolted together to capture an inner cylinder 200, which also comprises two halves that combine to define a cylinder that fits around the outer circumference of the driveshaft housing 26. Two bolts, 208 and 210, extend through the support cylinder 80 and the inner cylinder 200 to hold these four components rigidly together. To further tighten the support cylinder 80 and inner cylinder 200 around the outer surface of the driveshaft housing 26, a threaded lever 212 extends through holes in the extension tabs 118.

With continued reference to FIGS. 5 and 6, the angle plate 116 can be rigidly attached to a marine vessel transom. A rectangular tube 220 is rigidly attached to the angular plate 116 and provided with holes that allow pins, 224 and 226, to extend through the support cylinder 80 and the rectangular tube 220. By removing pin 226, the entire outboard motor can pivot about pin 224. The collar 124 can be rigidly attached to the driveshaft housing 26 by extending pin 230 through the collar 124 and one of the plurality of holes 92 formed through the driveshaft housing 26. The collar 124 can be attached to the driveshaft housing 26 at a position which determines the height of the engine 12 relative to the angle plate 116 which, in turn, is attached to the marine vessel. The outboard motor can be pivoted about pin 224 to allow the outboard motor to be set at a desired trim angle and several holes 232 are provided to allow the pin 226 to be replaced in adjacent holes to lock the outboard motor in the desired trim angle.

The present invention provides an inexpensive outboard motor that affords a marine vessel operator the convenience of a tiller handle 18 that is movable about an axis 20 so that the marine vessel operator can steer the vessel from different positions. The steering axis 22 is provided by the rotatable association of the driveshaft housing 26 and the support cylinder 80 which, in a preferred embodiment, comprises two halves that allow easy assembly. The outboard motor can be tilted about an axis 240 to select a desired trim angle. The support structure 10 provides a lifting handle 72 that allows the marine vessel operator to carry the outboard motor from one location to another. The tiller handle or steering handle 18 also comprises two portions that are slidable relative to each other to allow the steering handle 18 to be extended for further convenience to the operator. The height of the engine 12 relative to the transom of a marine vessel, as determined by angle plate 116, can be adjusted to several positions which are determined by the locations of a plurality of holes 92 and the selected position of a collar 124 relative to that plurality of holes. The reduced cost of the outboard motor made in accordance with the present invention allows it to be used in many parts of the world, both on working marine vessels and pleasure craft.

The present invention, as described above, provides an inexpensive marine propulsion apparatus that is flexible in use. For example, the pivoting steering handle 18 allows operation of the marine propulsion apparatus by the operator from several positions, including standing and using the steering handle in position 40 or sitting forward of the apparatus and using steering handle 18 in position 42. Steering is accomplished by causing the marine propulsion apparatus to rotate about axis 22 with the steering handle 18 rotated to a comfortable position about axis 20. To raise or lower the marine propulsion apparatus relative to a boat transom 84, the pin 90 is removed from its associated holes and the system shown in FIG. 1 is raised or lowered relative to the support cylinder 80. When an appropriate height is determined, the pin 90 is inserted through one of the plurality of holes 92 in the driveshaft housing 26 and through the hole in the support cylinder 80 to lock the marine propulsion apparatus in position.

Although the present invention has been described with particular detail and illustrated to show a preferred embodiment, alternative embodiments are also within its scope.

We claim:

1. A marine propulsion apparatus, comprising:

a support structure, said support structure being shaped to form a carrying handle;

an internal combustion engine attached for support to said support structure;

a bracket shaped to be attached to a marine vessel, said support structure being rotatably attached to said bracket;

a steering handle rotatably attached to said support structure, said steering handle being configured to rotate about a generally horizontal axis, said steering handle comprising a first portion of said steering handle and a second portion of said steering handle, said second portion of said steering handle being extendable from said first portion of said steering handle to increase the overall length of said steering handle;

a manually operable grip portion of said steering handle which is rotatable relative to said steering handle, the operating speed of said internal combustion engine being responsive to rotation of said grip portion relative to said steering handle;

a drive shaft housing extending from said internal combustion engine;

a drive shaft rotatably attached in torque transmitting relation to said internal combustion engine, said drive shaft being disposed within said drive shaft housing;

a propeller shaft supported by said drive shaft housing and connected in torque transmitting relation with said drive shaft, said bracket comprises a support cylinder, said drive shaft housing being slidably and rotatably disposed within said support cylinder;

a stop mechanism attached to said drive shaft housing, said stop mechanism being shaped to prevent said stop mechanism from moving into said support cylinder, set stop mechanism thereby limiting vertical movement of said drive shaft housing relative to said bracket; and a first locking mechanism attached to said steering handle for preventing rotation of said steering handle relative to said support structure.

2. The apparatus of claim 1, wherein:

said second portion of said steering handle comprises a plurality of holes which are alignable with at least one hole formed in said first portion of said steering handle, wherein a pin is disposable through one of said plurality of holes and through said at least one hole to prevent relative movement between said first and second portions of said steering handle.

3. The apparatus of claim 1, wherein:

said first portion of said steering handle is a tube and said second portion of said steering handle is disposed within said tube.

4. The apparatus of claim 1, wherein:

said stop mechanism is movable relative to said drive shaft housing to select a plurality of positions at which said stop mechanism can be attached to said drive mechanism to select a plurality of selectable heights of operation of said internal combustion engine relative to said bracket.

5. The apparatus of claim 1, further comprising:

a first locking mechanism attached to said steering handle for preventing rotation of said steering handle relative to said support structure; and a second locking mechanism attached to said first portion of said steering handle for preventing relative movement between said first and second portions of said steering handle.

* * * * *